US010259617B2

(12) United States Patent
Mélan-Moutet

(10) Patent No.: US 10,259,617 B2
(45) Date of Patent: Apr. 16, 2019

(54) CAP MADE OF SYNTHETIC MATERIAL

(71) Applicant: SOLOCAP-MAB, Contrexeville (FR)

(72) Inventor: Mathias Mélan-Moutet, Reims (FR)

(73) Assignee: SOLOCAP-MAB, Contrexéville (FR)

( * ) Notice: Subject to any disclaimer, the term of this patent is extended or adjusted under 35 U.S.C. 154(b) by 0 days.

(21) Appl. No.: 14/902,818

(22) PCT Filed: Jun. 12, 2014

(86) PCT No.: PCT/FR2014/051449
§ 371 (c)(1),
(2) Date: Jan. 4, 2016

(87) PCT Pub. No.: WO2015/004352
PCT Pub. Date: Jan. 15, 2015

(65) Prior Publication Data

US 2016/0176586 A1 Jun. 23, 2016

(30) Foreign Application Priority Data

Jul. 10, 2013 (FR) ..... 13 56785

(51) Int. Cl.
*B65D 41/04* (2006.01)
*B65D 41/32* (2006.01)
*B65D 41/34* (2006.01)

(52) U.S. Cl.
CPC ..... *B65D 41/0414* (2013.01); *B65D 41/0485* (2013.01); *B65D 41/325* (2013.01); *B65D 41/34* (2013.01); *B65D 41/349* (2013.01)

(58) Field of Classification Search
CPC .. B65D 41/0414; B65D 41/349; B65D 41/34; B65D 41/0485; B65D 41/325; B65D 2251/02; B65D 2251/023
USPC ..... 215/252, 329, 343, 344
See application file for complete search history.

(56) References Cited

U.S. PATENT DOCUMENTS 4,057,160 A * 11/1977 Victor ..... B65D 41/0414 215/318
4,460,100 A 7/1984 Libit
5,267,661 A * 12/1993 Luch ..... B65D 1/023 215/256
5,630,520 A * 5/1997 Luch ..... B65D 1/023 215/256
6,161,711 A * 12/2000 Miceli ..... B65D 50/061 215/206
7,185,776 B1 * 3/2007 Konefal ..... B65D 39/04 215/228

(Continued)

FOREIGN PATENT DOCUMENTS

GB 2 435 038 A 8/2007
RU 2011143963 A * 5/2013 ..... B65D 41/0485

(Continued)

OTHER PUBLICATIONS

Espacenet Bibliographic Data for US 2014/124471 (A1) prod.*

(Continued)

*Primary Examiner* — James N Smalley
(74) *Attorney, Agent, or Firm* — Christensen O'Connor Johnson Kindness PLLC

(57) ABSTRACT

The invention relates to a cap having a base portion (2A) that has been raised in order to match a circular internal capping wall (6) in order to provide a better grip when removing the cap.

10 Claims, 2 Drawing Sheets

(56) References Cited

U.S. PATENT DOCUMENTS

| | | | | |
|---|---|---|---|---|
| 2002/0056727 | A1 | 5/2002 | Brecheisen | |
| 2006/0000792 | A1* | 1/2006 | Hennebelle | B65D 41/0414 215/228 |
| 2006/0070973 | A1* | 4/2006 | Shingle | B65D 50/043 215/329 |
| 2006/0213861 | A1* | 9/2006 | Konefal | B65D 41/06 215/222 |
| 2008/0142473 | A1* | 6/2008 | Cho | B65D 51/285 215/252 |
| 2014/0124471 | A1* | 5/2014 | Vihorev | B65D 41/0485 215/316 |
| 2015/0129534 | A1* | 5/2015 | Falzoni | B65D 41/0421 215/316 |

FOREIGN PATENT DOCUMENTS

| | | | |
|---|---|---|---|
| WO | 2009-136836 | A1 | 11/2009 |
| WO | 2012/150309 | A1 | 11/2012 |

OTHER PUBLICATIONS

International Search Report dated Aug. 13, 2014, issued in corresponding International Application No. PCT/FR2014/051449, filed Jun. 12, 2014, 4 pages.

* cited by examiner

CAP MADE OF SYNTHETIC MATERIAL

The present invention relates to a stopper made of synthetic plastics material, for example PE, which is capable of being screwed onto the neck of a receptacle for sealing the opening thereof.

The synthetic material stopper according to the invention is particularly, although not exclusively, suitable for sealing receptacles containing carbonated drinks, mineral water, etc.

The prior art already discloses a synthetic material stopper in the form of a cap which can be mounted on the neck of a receptacle by screwing and comprises a circular stopping wall, which is carried by the base of the stopper and is capable of entering said neck, and a safety collar connected to said stopper by a pre-cut line and to said neck by retaining means. To open a receptacle equipped with such a stopper, the stopper is unscrewed, the unscrewing motion allowing the connection at the pre-cut between the safety collar and the stopper to be broken and said circular stopping wall to be removed from the neck of the receptacle.

It goes without saying that, in order for such a stopper to carry out its function properly, it is essential that the circular stopping wall applies tight friction to the neck of the receptacle and that the connection produced by the pre-cut line is sufficiently strong.

In addition, the driving force that the stopper has to apply during unscrewing has to be high in order for the pre-cut line to break and in order to remove the circular stopping wall from the neck of the receptacle.

To allow a manual user to apply a sufficient twisting moment to the stopper to bring about opening, the grip of said user on said stopper thus has to be sufficiently strong and comfortable.

However, in particular for cost reasons, it is not uncommon for the outer gripping surface of said stopper to be too small to permit a satisfactory manual grip and easy opening. In addition, owing to the outer gripping surface being small, the user may be made to involuntarily squeeze the safety collar, which further exacerbates the opening problems.

The object of the present invention is to overcome this drawback, without significantly increasing the cost of the stopper in the process.

To this end, according to the invention, the synthetic material stopper in the form of a cap which is capable of being mounted on the neck of a receptacle by screwing and comprises an internal circular stopping wall, which is carried by the base of said stopper and is capable of entering said neck, and a safety collar connected to said stopper by a pre-cut line and to said neck by retaining means is characterised in that the portion of said base that matches the internal circular stopping wall is raised on the outside in order to enlarge the outer gripping surface of said cap.

Therefore, owing to the present invention, a stopper is obtained in which the gripping surface is enlarged by the outer raised portion of said base while it is only the raised side wall that represents extra outlay for synthetic material in relation to the known cap. It should also be noted that, owing to the invention, the cavity defined by the internal circular stopping wall and the cavity defined by the external raised portion of the base thus join together to form a single large cavity having a smooth wall.

In order to increase the quality of the grip, the circular indentation formed between the raised portion and the non-raised portion can comprise gripping protrusions, for example diametric fins rigidly connected to the walls of said indentation.

The figures of the accompanying drawings will explain how the invention can be implemented. In these figures, identical reference numerals denote like elements.

Figure 1:
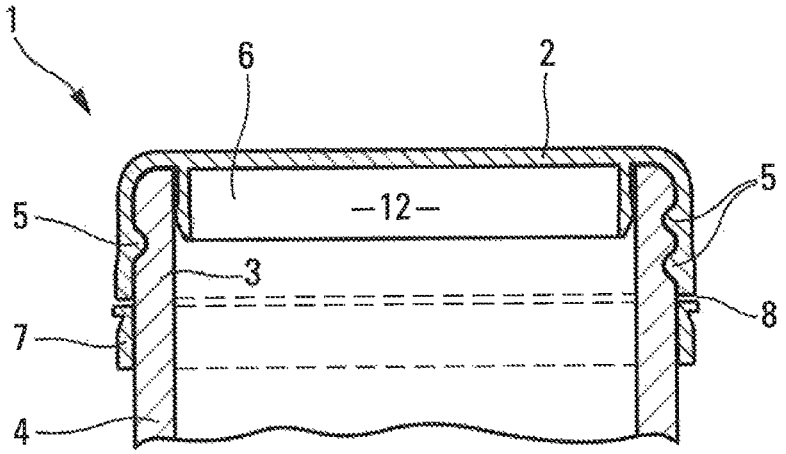
Fig. 1 (PRIOR ART)
FIG. 1 is a schematic axial section of a known stopper upon which the present invention shall improve.
Figure 6:
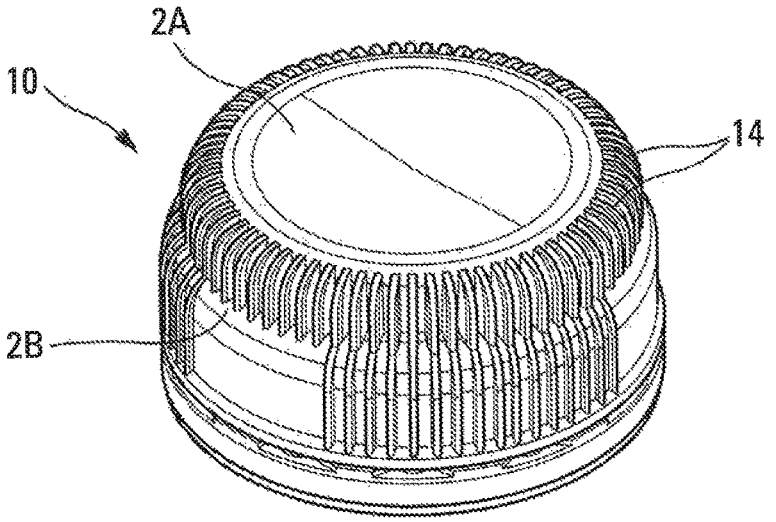
FIGS. 6 and 7 are perspective views from above and below, respectively, of the stopper from FIGS. 2 and 3.
Figure 7:
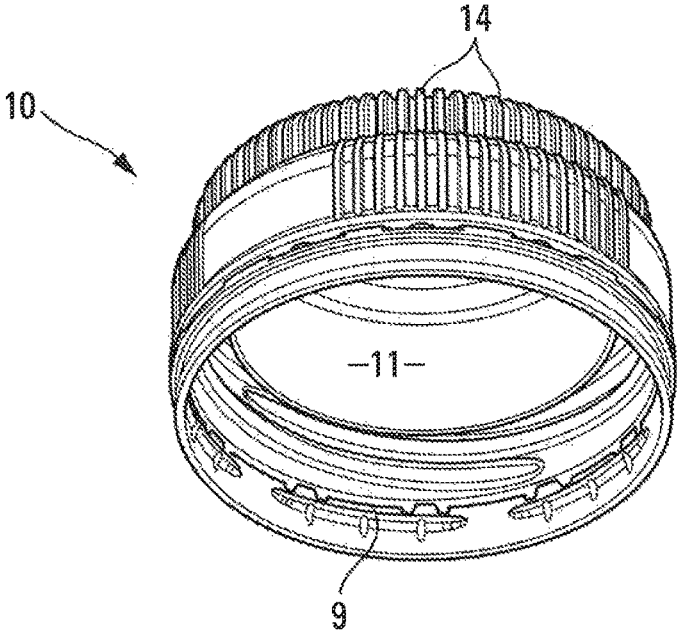
Figure 4:
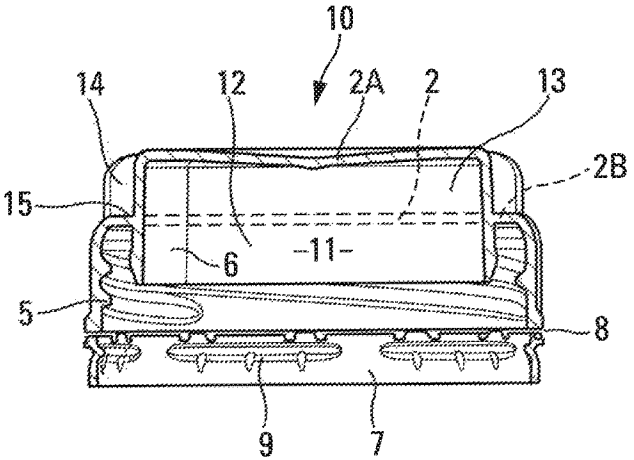
FIGS. 4 and 5 are diametric sections of the stopper from FIGS. 2 and 3, along the lines IV-IV and V-V, respectively, from this latter figure.
Figure 5:
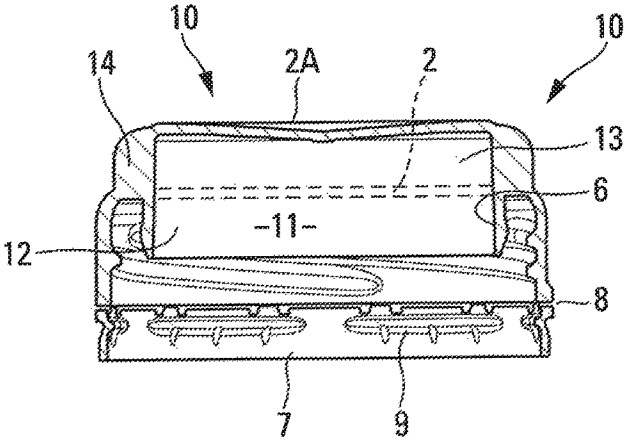
Figure 2:
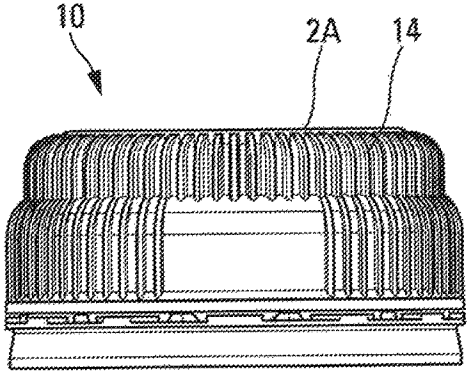
FIGS. 2 and 3 are a front view and a plan view, respectively, of an embodiment of the stopper according to the invention.
Figure 3:
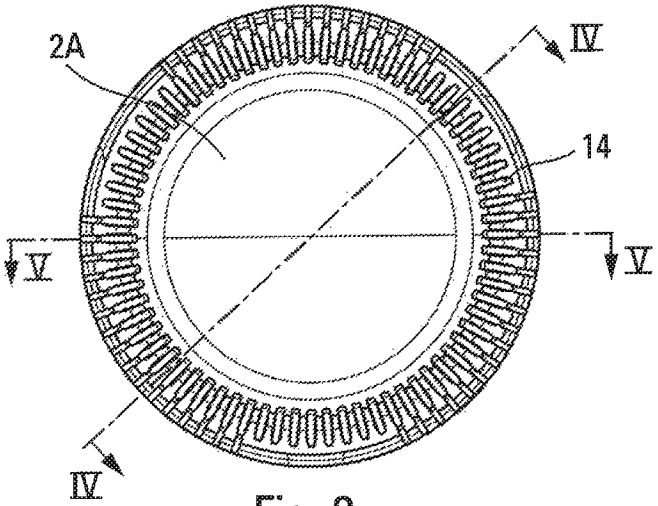

FIG. 1 is a schematic diametric section of a known synthetic material stopper 1, in the form of a cap, mounted on the neck 3 of a receptacle 4 in order to seal the opening thereof. The stopper 1 can be screwed onto the neck 3 as a result of threads 5, and comprises an internal circular stopping wall 6 which is carried by the base 2 and is capable of entering said neck 3.

In addition, the stopper 1 comprises a safety collar 7 which is connected to the lower portion of the stopper 1 by a pre-cut line 8.

In the sealing position (as shown in FIG. 1), the stopper 1 is screwed into the neck 3 to a maximum, the sealing internal circular stopping wall 6 being driven downwards therein and the safety collar 7 being held on said neck 3 by means of a known system of lugs 9 (not shown in FIG. 1 but identical to those visible in FIGS. 4 to 7), which interacts with retaining lugs (not shown) carried by said neck 3.

Therefore, to open the receptacle 4, the stopper has to be unscrewed and a sufficiently high twisting moment has to be exerted thereon to break the pre-cut line 8 and overcome the friction of the internal stopping wall 6 in the neck 3 of the receptacle. It goes without saying that, in order to apply this twisting moment, it is necessary for the operator's hand to grip the stopper 1 correctly, which is not always the case. As a result, the operator trying to open the receptacle 1 has problems and he has to exert himself.

To overcome these drawbacks, in the stopper 10 according to the invention, which is shown in FIGS. 2 to 7 and comprises the elements 5 to 8 described with regard to FIG. 1 (see mainly FIG. 4), the portion of the base 2 that matches the internal circular stopping wall 6 is raised (2A) on the outside. The base of the stopper 10 thus now comprises said raised portion 2A and a peripheral portion 2B.

The outer surface of the stopper 10 is thus larger than that of the stopper 1, such that the manual grip on the stopper 10 is increased and applying the opening twisting moment is simpler, without the amount of material used for making the stopper being significantly higher in order to do so.

Inside the stopper 10, a single large cavity 11 having a smooth wall is formed, which cavity is made up of the combination of the cavity 12 defined by the internal circular stopping wall 6 and the cavity 13 created by the portion 2A of the base 2 being raised.

To improve the grip on the stopper 10, gripping protrusions 14 are arranged in the circular indentation 15 between the raised portion 2A and the non-raised portion 2B of the base 2. Gripping protrusions of this type can be diametric fins that are rigidly connected to the walls of the indentation 15.

The invention claimed is:

1. A synthetic material stopper, which is configured for mounting on a neck of a receptacle, the stopper comprising:

a base having an internal circular stopping wall extending toward a lower portion of the stopper, the internal stopping wall configured to enter said neck; and a safety collar connected to the lower portion of the stopper by a pre-cut line and removably couplable to said neck by retaining means, wherein a portion of said base extends upward from said internal circular stopping wall to form a raised portion to enlarge an outside surface for gripping said cap, wherein a circular indentation is formed between the raised portion and a non-raised portion of the base, the circular indentation comprising gripping protrusions having a plurality of first diametric fins extending radially outwardly from the wall of the raised portion, and wherein the stopper further comprises an external surface between the lower portion of the stopper and the raised portion of the base, said external surface positioned radially outwardly from the plurality of first diametric fins, the external surface having a plurality of second diametric fins extending radially outwardly therefrom, each of the second diametric fins being longitudinally extended by a respective first diametric fin.

2. The stopper according to claim 1, wherein a first cavity defined by the internal circular stopping wall and a second cavity created by the raised portion of the base together form a single large cavity having a smooth wall.

3. The stopper according to claim 1, wherein the second diametric fins are fewer in number than the first diametric fins.

4. A synthetic material stopper, which is configured for mounting on a neck of a receptacle, the stopper comprising:

a base having an internal circular stopping wall extending toward a lower portion of the stopper, the internal stopping wall configured to enter said neck, the stopping wall defining a first cavity positioned radially inwardly from a threaded surface of the base;

a safety collar connected to the lower portion of said stopper by a pre-cut line and removably couplable to said neck by retaining means; and a raised wall extending upward from the stopping wall in a direction away from the safety collar, the raised wall defining a second cavity and forming a portion of the stopper absent threads;

wherein the stopping wall and the raised wall are of substantially similar heights such that the first cavity and the second cavity form substantially similar volumes, and wherein the second cavity is configured to enlarge the outside surface for gripping said cap, and wherein a circular indentation is formed between the portion radially outwardly from the raised wall and the base, the circular indentation and the raised wall together comprising gripping protrusions.

5. The stopper according to claim 4, wherein the first cavity and the second cavity together form a single large cavity having a smooth inner wall.

6. The stopper according to claim 4, wherein said gripping protrusions include diametric fins which are rigidly connected to both the circular indentation and the raised wall.

7. A synthetic material stopper, which is configured for mounting on a neck of a receptacle, the stopper comprising:

a base having an internal circular stopping wall extending toward a lower portion of the stopper, the internal stopping wall configured to enter said neck, the stopping wall defining a first internal cavity positioned radially inwardly from a threaded surface of the base;

a safety collar connected to the lower portion of the stopper by a pre-cut line and removably couplable to said neck by retaining means;

a raised wall extending upward from the stopping wall in a direction away from the safety collar, the raised wall defining a second internal cavity;

a plurality of gripping protrusions forming first diametric fins extending radially outwardly from an outer surface of the second cavity, each gripping protrusion having a height equal to the height of the other of the plurality of gripping protrusions, wherein the gripping protrusions extend along the height of the second internal chamber, and wherein the plurality of gripping protrusions enlarge the outside surface for gripping said cap; and an external surface between the lower portion of the stopper and the non-raised portion of the base, said external surface positioned radially outwardly from the plurality of first diametric fins, the external surface having a plurality of second diametric fins extending radially outwardly therefrom, each of the second diametric fins being longitudinally extended by a respective first diametric fin.

8. The stopper according to claim 7, wherein the first cavity and the second cavity together form a single large cavity having a smooth inner wall.

9. The stopper according to claim 7, wherein a circular indentation is formed between the portion radially outwardly from the raised wall and the base, the circular indentation comprising the plurality of gripping protrusions.

10. The stopper according to claim 7, wherein the second diametric fins are fewer in number than the first diametric fins.

* * * * *